United States Patent [19]

Justesen

[11] Patent Number: 4,863,151

[45] Date of Patent: Sep. 5, 1989

[54] VISE JIG TOOL

[76] Inventor: Scott F. Justesen, 9710 223rd St. North, Forest Lake, Minn. 55025

[21] Appl. No.: 273,061

[22] Filed: Nov. 18, 1988

[51] Int. Cl.[4] ..... B25B 1/24

[52] U.S. Cl. ..... 269/261; 269/283

[58] Field of Search ..... 269/261-262, 269/265, 296-302, 303-304, 283; 409/903, 168, 224

[56] References Cited

U.S. PATENT DOCUMENTS

| | | | |
|---|---|---|---|
| 119,327 | 9/1871 | Coyne . | |
| 449,987 | 4/1891 | Wies | 269/261 |
| 2,284,449 | 5/1942 | Rodess . | |
| 2,502,124 | 3/1950 | Bray | 269/258 |
| 2,881,667 | 4/1959 | Ebert | 269/258 |
| 3,109,242 | 11/1963 | Nyitrai | 269/259 |
| 4,383,682 | 5/1983 | Feinberg . | |
| 4,706,949 | 11/1987 | Dossey . | |

FOREIGN PATENT DOCUMENTS

| | | | |
|---|---|---|---|
| 722447 | 1/1955 | United Kingdom | 269/261 |

*Primary Examiner*—Robert C. Watson

*Attorney, Agent, or Firm*—Jacobson & Johnson

[57] ABSTRACT

A jaw jig tool for quick precision alignment and attachment to the jaw of a machine vise comprising a first elongated jaw member having a finished surface for mating against and over the jaw of a machine vise and a fastener for engaging the jaw of a machine vise to hold the jaw jig tool on the jaw of the machine vise. The elongated jaw member includes a finished bottom surface for aligning with a finished surface on the machine vise and pivot holes for pivotally mounting a work guide having a pivot pin for pivotally mounting in the pivot hole in the elongated jaw member and a face with a graduated scale to permit an operator to set the angle of the work guide and a fastener for securing said work guide at the proper angle on the elongated jaw member.

10 Claims, 2 Drawing Sheets

VISE JIG TOOL

FIELD OF THE INVENTION

This invention relates generally to vise jig tools and, more specifically, to a jaw jig that enables a user to quickly and efficiently hold an article to be machined at the proper angle.

BACKGROUND OF THE INVENTION

The concept of jigs for attachment to a machine vise is well known in the art. Typically, the machine vise has a stationary jaw and a movable jaw that is brought toward the stationary jaw to clamp an article to be machined between the two jaws. One of the difficulties with the vise is that it does not have a work guide surface for holding an article at the proper angle for machining. The present invention provides an improved vise jig tool that enables the user to quickly and efficiently attach the jig tool to the rise jaw to hold the article to be machined at the proper angle.

DESCRIPTION OF THE PRIOR ART

The prior art includes cumbersome inventions that have been conceived to address the problem of accurately locating a workpiece in relation to the cutting tool of the machine. The following prior art patents show attachment devices for jaw vises beginning in 1871 and continuing through 1985.

The 1871 Coyne U.S. Pat. No. 119,327 shows an attachment that has a member for attaching to a vise jaw for the purpose of holding a wedge like object.

The 1939 Rodess U.S. Pat. No. 2,284,449 shows a vise having an attachment with a semicylindrical surface to engage a cylindrical object.

The 1981 Feinberg U.S. Pat. No. 4,383,682 shows a vise jaw attachment having a rotatable or inclined platform located in the middle of the attachment and having an indexed rotator to rotate the inclined platform. The Feinberg inclined platform forms part of the movable jaw of the vise to form a platform to hold the article at an angle while the article is clamped in the jaws.

The 1985 Dossey U.S. Pat. No. 4,706,949 shows a vise jaw attachment with an inclined platform formed by an angle setting arm that can be positioned laterally along the jaw and held in position by tightening a tee nut. Each of the attachments has a rib for engaging jaw adaptor assembly for mounting to a vise jaw.

The prior art devices showing inclined platforms suffer from having moving parts that can be jammed if small chips from the cutting operation come into contact with the surfaces that have to be moved relative to one another. In addition the prior art inclined platforms ar relatively complicated mechanically and can be difficult to set up for holding an article.

BRIEF SUMMARY OF THE INVENTION

Briefly, the present invention comprises a jaw jig tool having guide surfaces for mounting over the outside of the stationary jaw with threaded fasteners to permit quick attachment or removal of the jaw jig tool to a stationary vise jaw. The jaw jig tool includes a work guide that is positionable and securable in three different locations along the front face of the jaw jig with the work guide having 360 degrees of rotation and having an indicator to permit alignment of the work guide with an alignment marking on the jaw jig. The jaw jig also includes means for securing the work guide at the proper angle.

DESCRIPTION OF THE PREFERRED EMBODIMENT

Figure 1:
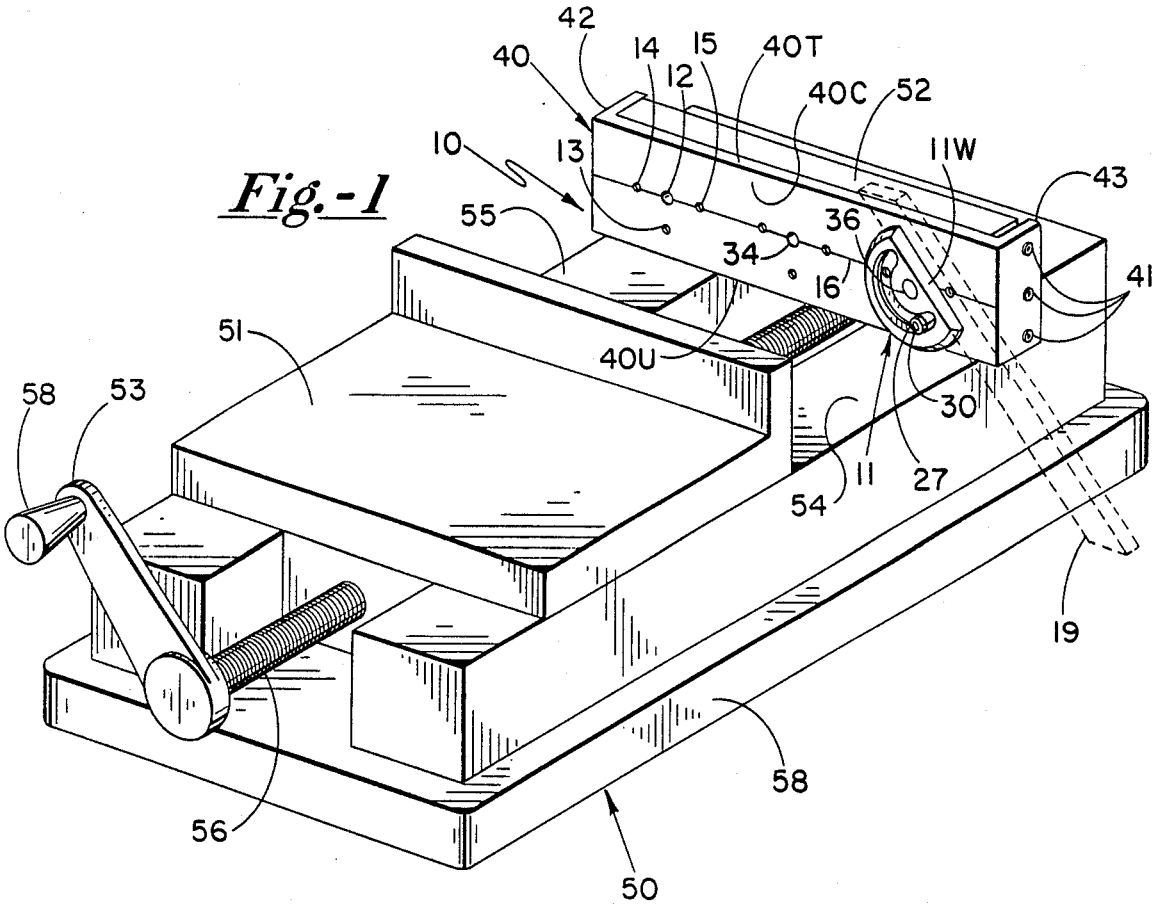
FIG. 1 is a perspective view of my jaw jig mounted on the stationary jaw of a conventional machine vise.

Referring to FIG. 1 reference numeral 10 identifies the jaw jig tool of my invention attached to a stationary jaw 52 of machine vise 50. Machine vise 50 is known in the art and comprises a stationary jaw 52 and a movable jaw 51 which slides along parallel guide members 54 and 55 located on bed 59. A threaded member 56 that is connected to handle 58 through arm 53 permits the operator to rotate member 56 to move movable jaw 51 toward or away from fixed jaw 52. The top surfaces of guide members 54 and 55 as well as the front face of stationary jaw 52 have finished surfaces that permit the machine operator to use the finished surfaces as reference surfaces for measuring during machining operations.

Figure 4:
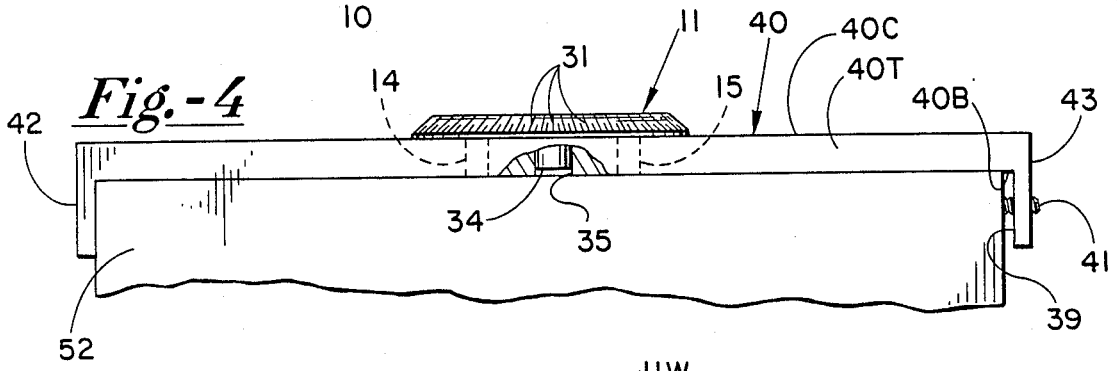
FIG. 4 shows a top view of my jaw jig attached to a vise jaw.
Figure 5:
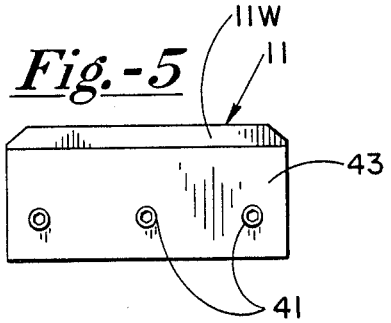
FIG. 5 shows an end view of my jaw jig.

FIG. 1 shows the elongated U shaped metal jaw jig 10 comprising a rectangular shaped front member 40 having a typical thickness of less than a ½ inch and which may have a hardened surface to grip an article. Jig 10 includes a first end member 42 and a second end member 43 that fit over the edges of jaw 52. End member 43 contains three set screws 41 that permit an operator to quickly fasten jaw jig 10 to stationary jaw 52, i.e., rotation of set screws 41 cause the ends of screws 41 to engage and form pressure contact with the side of jaw 52 as illustrated in FIG. 4. To provide for accurate mounting of jaw jig 10 on jaw 52, front member 40 has a finished back surface 40B (FIG. 4) that can be mounted flush against the finished front face of jaw 52. Back surface 40B is parallel to a front finished surface 40C so that when jaw jig 10 is mounted on jaw 52 the front surface 40C is parallel to the finished front face on jaw 52. Front member 40 also has a finished under surface 40U that rests on the finished surfaces of guide members 54 and 55 to permit quick, accurate horizontal placement of jaw jig 10 in vise 50. Front member 40 has a top finished surface 40T that is parallel to finished surface 40U to permit surface 40T to be used as a reference surface.

Figure 2:
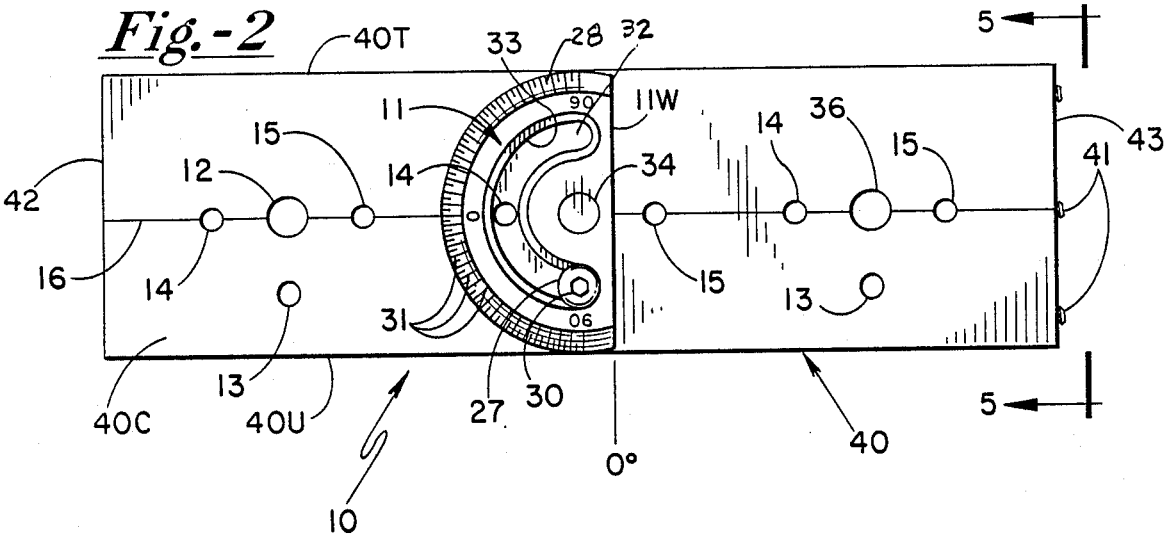
FIG. 2 is a front view of my jaw jig with work guide located in a vertical orientation and facing toward the right.

FIG. 2 shows jaw jig in a front view with a rotatable and removable work guide 11 having a work guide surface 11W located in a right vertical orientation. Work guide 11 comprises a semicircular shaped member that is mounted on a cylindrical pin 34 that is rotatable mounted in opening 35 in front member 40 (FIG. 4). Work guide 11 is slightly larger than a semicircle to permit the mounting of pin 34 at the geometric center of the circular portion of work guide 11. Located on the curved outer beveled face of work guide 11 is a curved scale face 28 which is divided into degree graduations 31. Located inward of curved scale face 28 is an arcuate opening 32 that is surrounded by an arcuate lip 33 that extends outward and inward to provide a ledge for screw head 30 of lockdown screw 27 to engage and securely hold work guide 11 in position against front surface 40C. The recessing of lip 33 permits screw head 30 to be located below the front surface of work guide 11 so that screw head 30 does not engage the opposite jaw and also to keep the protruding profile of jaw jig 10 to a minimum. FIG. 4 shows work guide 11 rotated with the only frontward projecting member on jaw jig 10 is work guide 11 since screw head 30 is located beneath the front face of work guide 11. Screw 27 can be removed to permit the operator to remove work guide 11 and reposition guide 11 to another location. Screw head 30 contains an allen head opening to permit an operator to quickly tighten or loosen screw 27 to enable an operator to precisely set the angle on work guide surface 11W.

In operation of my work guide 11 the operator has the choice of mounting work guide 11 in any of three different pivot holes 12, 35, or 36 which are located in the front face of member 40 and on a reference line 16 which is parallel to surface 40U. The use of multiple locating holes allows an operator to laterally reposition the work guide to accommodate the length or size of an article. That is, in order to get the portion of the article to be machined as close to the top of the vise jaws as possible, it is sometimes necessary to grip the article at the sides of the jaws rather than the middle of the jaw. FIG. 1 illustrates in phantom an elongated article 19 located at the end of vise 50 to accommodate a piece that extends beyond vise 50.

In order to provide for positioning and alignment of work guide 11 at multiple locations on front member 40 I provide a horizontal reference line 16 that is parallel to undersurface 40U and extends across the face of member 40. Reference line 16 can be used to set work guide 11 at the proper angle regardless of the location of work guide 11 in front member 40. Also located in front member 40 and around pivot hole 12 are a set of three threaded openings 13, 14, and 15 which receive the threaded stud bolt or screw 27 that includes an enlarged head 30 that engages lip 33 to hold work guide 11 in fixed position when screw 27 is tightened. While only one threaded opening 13 is necessary to secure work guide 11, which can be rotated 360 degrees, I provide additional threaded openings 14 and 15 to permit the operator to use additional screws to more securely lock work guide 11 to front member 40.

Figure 3:
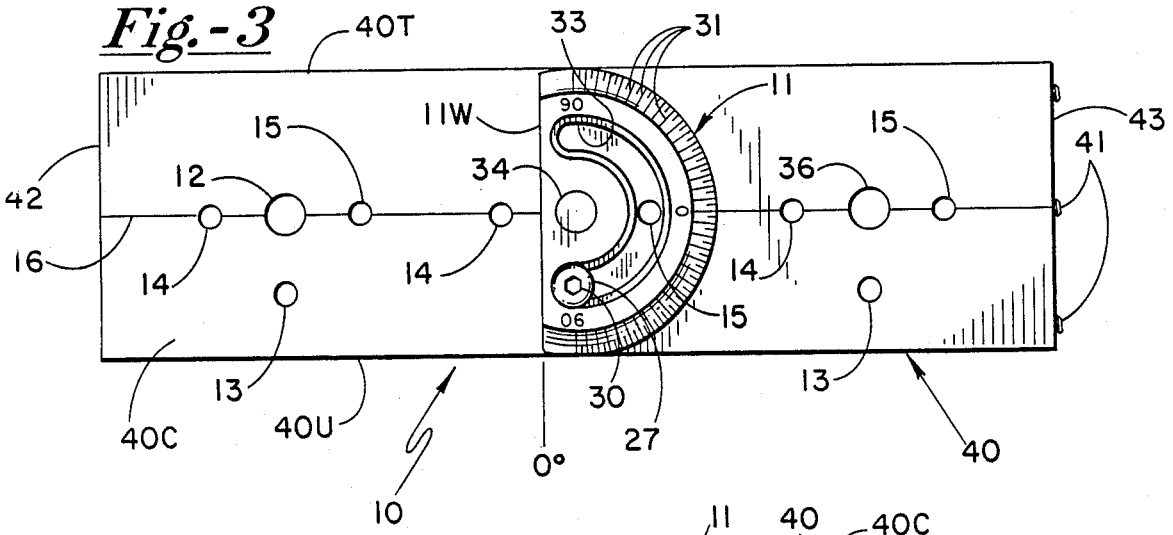
FIG. 3 shows a front view of my jaw jig with the work guide located in a vertical orientation and facing toward the left.

Viewing FIG. 2 and FIG. 3 illustrates how work guide 11 can be rotated 360 degrees to permit work guide surface 11W to face left vertical or face right vertical.

In order to provide work guide 11 with the proper rotational alignment with respect to front member 40, I provide pivot pin 34 with a length that is less than the thickness of front member and a diameter that provides a slip fit (clearance of approximately 0.0005") in pivot holes 12, 35, or 36 (FIG. 4). Some of the practical advantages of my invention is that the device has relatively few parts, cannot get out of alignment and can be quickly and easily taken apart and cleaned if particles should get on the work surface of the jig. In addition, the use of finished surfaces on the jig permits the operator to quickly align the jig on the vise jaw and the guide members 54 and 55 thereby enabling the operator to attach or remove jig 10 as the need arises.

I claim:

1. A jaw jig tool for quick precision alignment and attachment to the jaw of a machine vise comprising:

a first elongated member having a finished surface for mating against and over the jaw of a machine vise, said first member having an end member connected thereto with means therein for engaging the jaw of the machine vise to hold said elongated member on the jaw of the machine vise, said elongated member having at least three pivot holes for pivotally mounting a work guide at various lateral locations on said elongated member ;

a work guide, said work guide having a pivot pin for pivotally mounting of said work guide in said pivot hole in said elongated member, said work guide having a face with graduated scale to permit an operator to select the angle of the work guide, said work guide having a semicircular shape with a flat work surface for locating an article on said work surface, said work guide having an arcuate opening with an arcuate lip extending around the opening to provide an edge to secure said work guide to said elongated member;and further means for securing said work guide at the proper angle on said front member.

2. The jig tool of claim 1 wherein said elongated member is rectangular and has a finished surface for forming alignment with a finished surface on a machine vise.

3. The jig tool of claim 2 wherein said elongated member is attached to the fixed jaw of a machine vise.

4. The jig tool of claim 3 wherein said pivot pin has a diameter that forms a slip fit with said pivot holes in said elongated member.

5. The jig tool of claim 4 wherein said elongated member has a horizontal reference extending across said elongated member.

6. The jig tool of claim 5 wherein said pivot pin is located at the geometric center of said semicircular shaped work guide.

7. The jig tool of claim 6 wherein said work guide has a front face and further means for securing said work guide is located at least flush with the front face of said work guide.

8. The jig tool of claim 7 wherein said elongated member includes at least three threaded openings for engagement with said further means for securing said work at the proper angle.

9. The jig tool of claim 8 wherein said elongated member has a U shape with end members for extending over the sides of the jaws of a machine vise.

10. The jig tool of claim 9 wherein said work guide extends from said elongated member less than one quarter of an inch.

* * * * *